US010353326B1

(12) United States Patent
Omura

(10) Patent No.: US 10,353,326 B1
(45) Date of Patent: Jul. 16, 2019

(54) FIXING DEVICE HAVING RECIPROCATING SEPARATING CLAW AND IMAGE FORMING APPARATUS

(71) Applicant: KYOCERA Document Solutions Inc., Osaka (JP)

(72) Inventor: Hiroyoshi Omura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/237,986

(22) Filed: Jan. 2, 2019

(30) Foreign Application Priority Data

Jan. 9, 2018 (JP) ..... 2018-001290

(51) Int. Cl.
*G03G 15/20* (2006.01)
*G03G 15/00* (2006.01)
*B65H 29/56* (2006.01)

(52) U.S. Cl.
CPC ..... *G03G 15/2028* (2013.01); *B65H 29/56* (2013.01); *G03G 15/6532* (2013.01); *G03G 2215/00573* (2013.01)

(58) Field of Classification Search
CPC ..... G03G 15/2028; G03G 15/6532; G03G 2215/00573; B65H 29/56
USPC ..... 399/323, 398, 399; 271/307, 311, 900
See application file for complete search history.

(56) References Cited

U.S. PATENT DOCUMENTS 4,951,936 A * 8/1990 Taniyama ..... G03G 15/6532 271/307
2002/0141792 A1* 10/2002 Nakano ..... G03G 15/2028 399/323
2006/0269332 A1* 11/2006 Yamanaka ..... G03G 15/2028 399/323
2015/0205240 A1* 7/2015 Ohata ..... G03G 15/2028 399/323

FOREIGN PATENT DOCUMENTS

JP 60097373 A * 5/1985 ..... G03G 15/6532
JP 07152260 A * 6/1995
JP 07261589 A * 10/1995
JP 09211995 A * 8/1997
JP 09240877 A * 9/1997
JP 2011-164446 A 8/2011

* cited by examiner

*Primary Examiner* — Robert B Beatty
(74) *Attorney, Agent, or Firm* — Studebaker & Brackett PC

(57) ABSTRACT

A fixing device includes a fixing member, a pressuring member, a separating claw separating a recording medium from the fixing member and a moving mechanism of the separating claw. The moving mechanism includes a biasing member, coaxial two input gears having different numbers of teeth, a bearing depression and a shaft protrusion. The two input gears rotate according to rotation the fixing or pressuring member while shifting by a difference of the numbers of teeth for each rotation. The bearing depression is depressed in one input gear, and has an inclined contact face. The shaft protrusion is protruded from the other input gear, and has an inclined distal end face contact with the contact face. The two input gears rotate to repeat coincidence of (Continued)

inclination directions of the contact face and the distal end face and shifting the inclination directions, and reciprocatingly move the separating claw.

14 Claims, 13 Drawing Sheets

FIXING DEVICE HAVING RECIPROCATING SEPARATING CLAW AND IMAGE FORMING APPARATUS

INCORPORATION BY REFERENCE

This application is based on and claims the benefit of priority from Japanese Patent application No. 2018-001290 filed on Jan. 9, 2018, the entire contents of which are incorporated herein by reference.

BACKGROUND

The present disclosure relates to a fixing device and an image forming apparatus including this fixing device.

An image forming apparatus of an electrographic manner includes a fixing device fixing a toner image on a recording medium, such as a sheet.

For example, the fixing device includes an image forming part transferring a toner image from an image carrier to a recording medium and a fixing unit configured to include a heating roller fixing the toner image transferred on the recording medium and a separating claw. The fixing unit includes a separating claw moving mechanism moving the separating claw along a surface of the heating roller and separating the recording medium from the heating roller. The fixing unit includes a controlling part controlling the separating claw moving mechanism so that moving speed V2 of the separating claw when separating the recording medium is more than moving speed V1 of the separating claw until the following recording medium reaches the separating claw after separating the recording medium. Thereby, it is possible to execute separating operation of the recording medium as stabilizing contact condition of the separating claw with respect to the heating roller. As a result, wear of the surface of the heating roller is restrained.

However, in the above-mentioned fixing device, when separating the recording medium and after separating recording medium, the controlling part controls a special motor to change the moving speed of the separating claw. Therefore, it is necessary to install the special motor and others in order to move the separating claw, and then, there are a problem that manufacturing cost of the fixing device is increased and a problem that the fixing device is enlarged. Moreover, it is necessary to carry out complicated control in order to change the moving speed of the separating claw, and then, this becomes a factor increasing manufacturing cost of the fixing device.

SUMMARY

In accordance with the present disclosure, a fixing device includes a fixing member, a pressuring member, a separating claw and a moving mechanism. The fixing member is rotatably provided around an axis, and heats a toner image on a recording medium. The pressuring member is rotatably provided around an axis, forms a pressuring area between the fixing member and the pressuring member, and pressures the recording medium passing through the pressuring area. The separating claw separates the recording medium passed through the pressuring area from a surface of the fixing member. The moving mechanism reciprocatingly moves the separating claw in an axial direction in accordance with rotation of the fixing member or the pressuring member. The moving mechanism includes a biasing member, two input gears, a bearing depression and a shaft protrusion. The biasing member biases the separating claw from one side to the other side in the axial direction. The two input gears have different numbers of teeth from each other, are arranged side by side on the same axis as each other, are meshed with one output gear driven and rotated by a driving source driving and rotating the fixing member or the pressuring member, and rotate around an axis while shifting by a difference of the numbers of teeth for each rotation in a rotation direction. The bearing depression is formed in one input gear of the input gears in a depressed condition, and has a contact face inclined with respect to the axial direction in a bottom face of the bearing depression. The shaft protrusion is protruded from the other input gear to the one input gear of the input gears, and is supported by the bearing depression in a condition that a distal end face inclined with respect to the axial direction in the shaft protrusion is made contact with the contact face. The two input gears is rotated so as to repeat a condition being biased by the biasing member to make inclination directions of the contact face and the distal end face coincident with each other and a condition being separated from each other against biasing force of the biasing member by shifting the inclination directions of the contact face and the distal end face in the rotation direction, and thereby, reciprocatingly move the separating claw in the axial direction.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
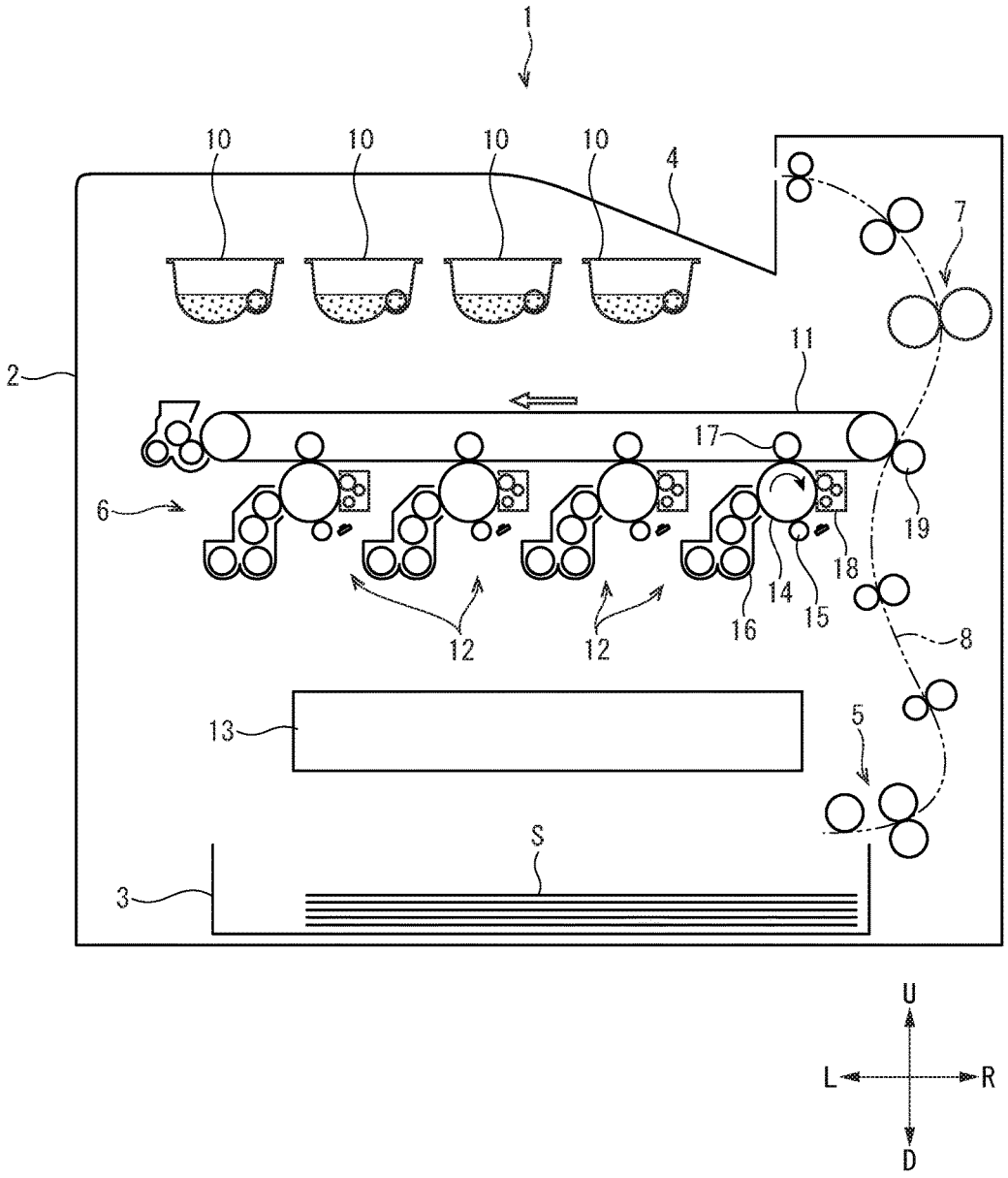
FIG. 1 is a sectional view schematically showing an internal structure of a color printer according to an embodiment of the present disclosure.

Hereinafter, with reference to the accompanying drawings, an embodiment of the present disclosure will be described. Incidentally, in the drawings, a reference character "Fr" indicates a "front" side, a reference character "Rr" indicates a "rear" side, a reference character "L" indicates a "left" side, a reference character "R" indicates a "right" side, a reference character "U" indicates an "upward" side, and a reference character "D" indicates a "downward" side. Moreover, terms "upstream" and "downstream" and other terms similar to these indicate an "upstream" side and a "downstream" side in a conveying direction (a passing direction) of a sheet S and other expressions similar to these.

With reference to FIG. 1, a color printer 1 as an example of an image forming apparatus will be described. FIG. 1 is a sectional view schematically showing an internal structure of the color printer 1 as viewed from a front side.

The color printer 1 includes a roughly rectangular parallelepiped apparatus body 2 constituting an external appearance. At a lower side of the apparatus body 2, a sheet feeding cartridge 3 storing sheets S (recording mediums) made of paper is detachably attached. On an upper face of the apparatus body 2, an ejected sheet tray is provided. Incidentally, the sheet S is not restricted by paper, but may be made of resin or others.

Moreover, the color printer 1 includes a sheet feeding device 5, an imaging device 6 and a fixing device 7 inside the apparatus body 2. The sheet feeding device 5 is provided in an upstream end of a conveying path 8 extended from the sheet feeding cartridge 3 to the ejected sheet tray 4. The fixing device 7 is provided at a downstream side in the conveying path 8 and the imaging device 6 is provided between the sheet feeding device 5 and the fixing device 7 in the conveying path 8.

The imaging device 6 includes four toner containers 10, an intermediate transfer belt 11, four drum units 12 and an optical scanning device 13. In the four toner containers 10, toners (developers) of four colors (yellow, magenta, cyan and black) are contained. Each drum unit 12 includes a photosensitive drum 14, a charging device 15, a development device 16, a primary transferring roller 17 and a cleaning device 18. The primary transferring roller 17 is arranged so as to put the intermediate transfer belt 11 between the photosensitive drum 14 and the primary transferring roller 17. With a right side of the intermediate transfer belt 11, a secondary transferring roller 19 comes into contact to form a transferring nip.

A controlling device (not shown) of the color printer 1 suitably controls each component to execute image forming process as follows. The charging device 15 electrically charges a surface of the photosensitive drum 14. The photosensitive drum 14 receives scanning light emitted from the optical scanning device 13 to carry an electrostatic latent image. The development device 16 develops the electrostatic latent image on the photosensitive drum 14 to a toner image by using the toner supplied from the toner container 10. The primary transferring roller 17 primarily transfers the toner image on the photosensitive drum 14 to the intermediate transferring belt 11 being rotated. The intermediate transferring belt 11 rotates and carries the toner image of full color formed by laminating the toner images of four colors. The sheet S is fed out from the sheet feeding cartridge 3 to the conveying path 8 by the sheet feeding device 5. The secondary transferring roller 19 secondarily transfers the toner image on the intermediate transferring belt 11 to the sheet S passing through the transferring nip. The fixing device 7 thermally fixes the toner image to the sheet S. After that, the sheet S is ejected to the ejected sheet tray 4. The cleaning device 18 removes the toner remained on the photosensitive drum 14.

Figure 2:
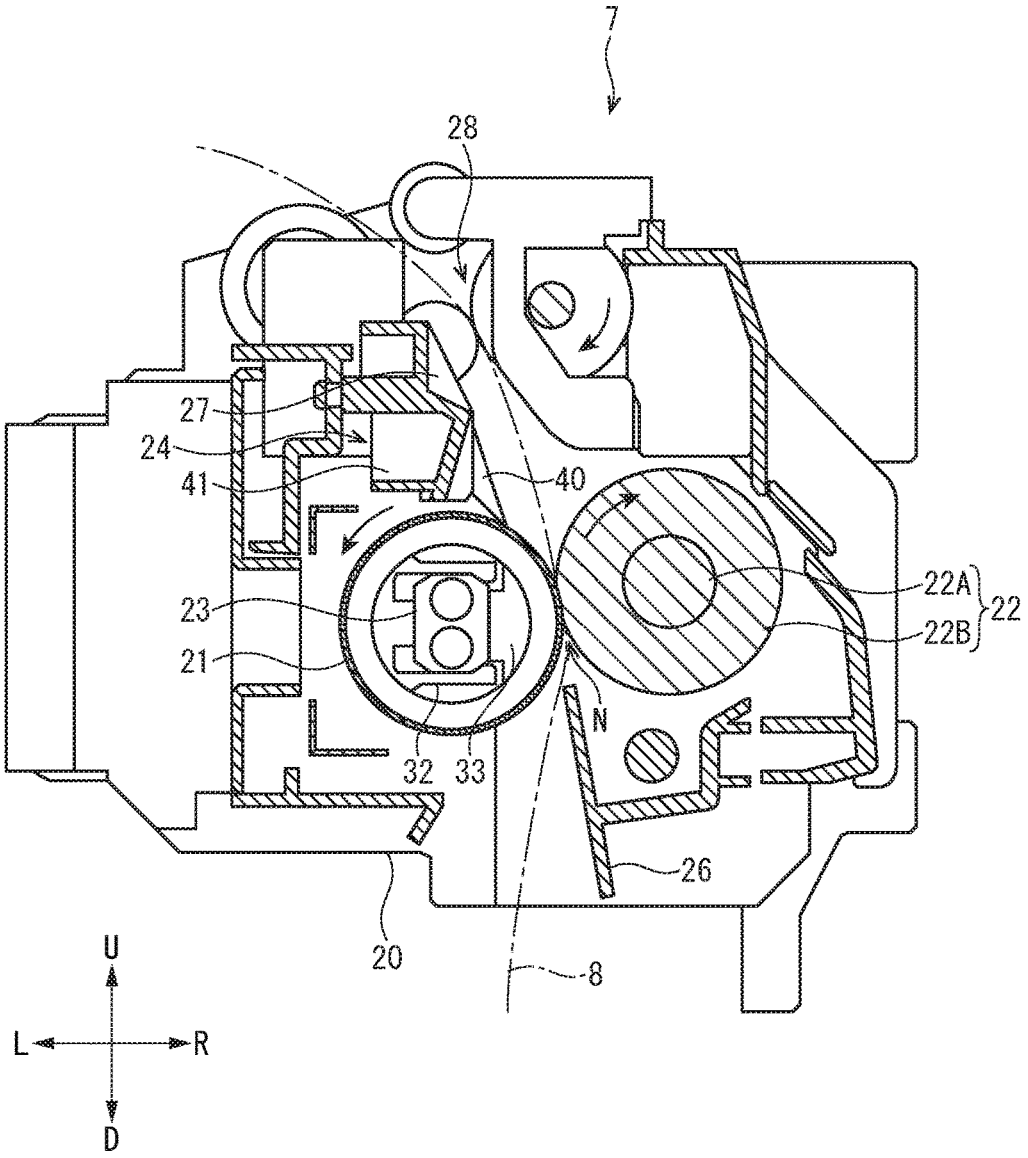
FIG. 2 is a sectional view showing a fixing device according to the embodiment of the present disclosure.
Figure 3:
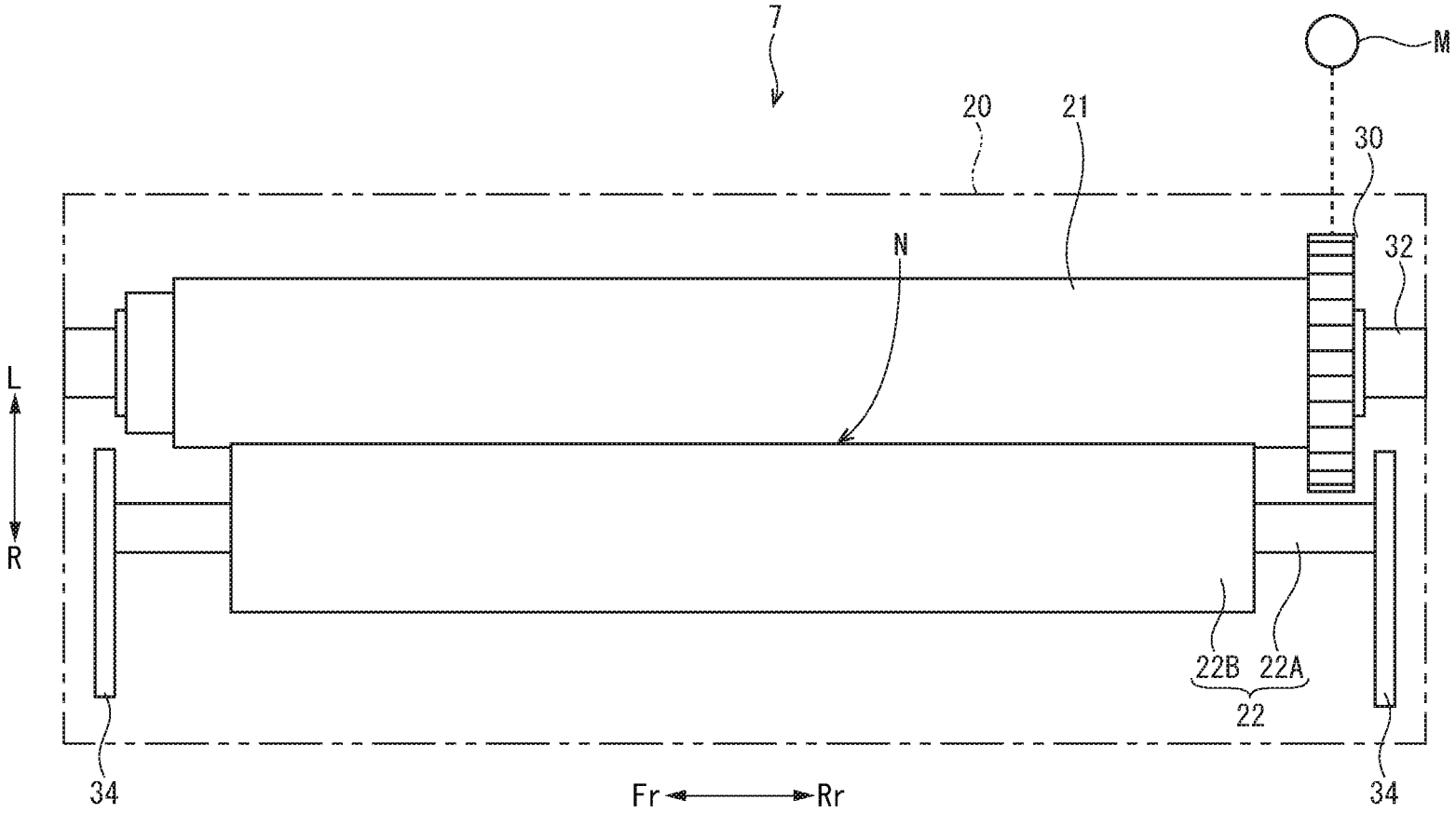
FIG. 3 is a plane view schematically showing a part of the fixing device according to the embodiment of the present disclosure.
Figure 5:
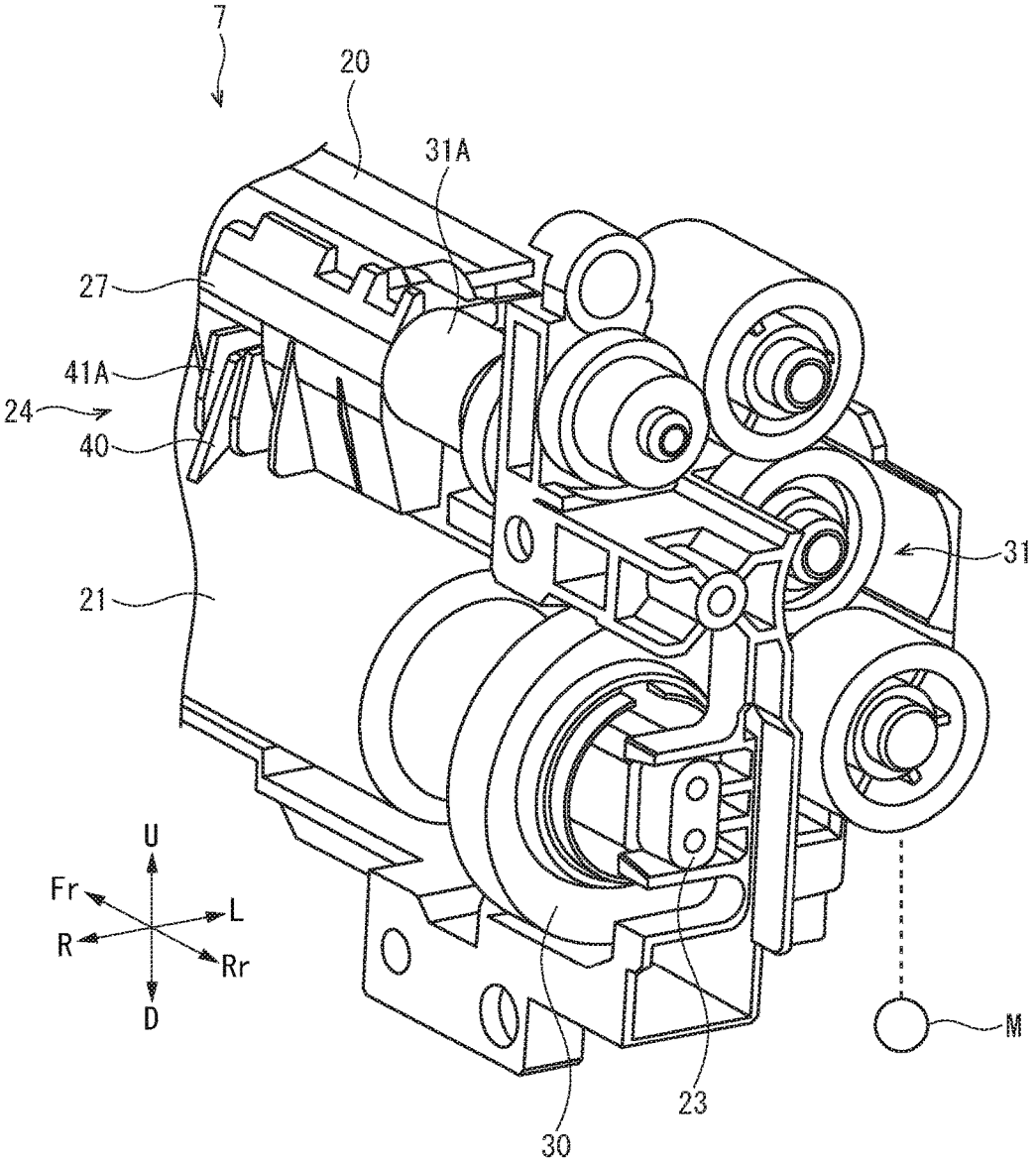
FIG. 5 is a perspective view showing rear sides of the fixing belt, the separating unit and others in the fixing device according to the embodiment of the present disclosure.
Figure 6:
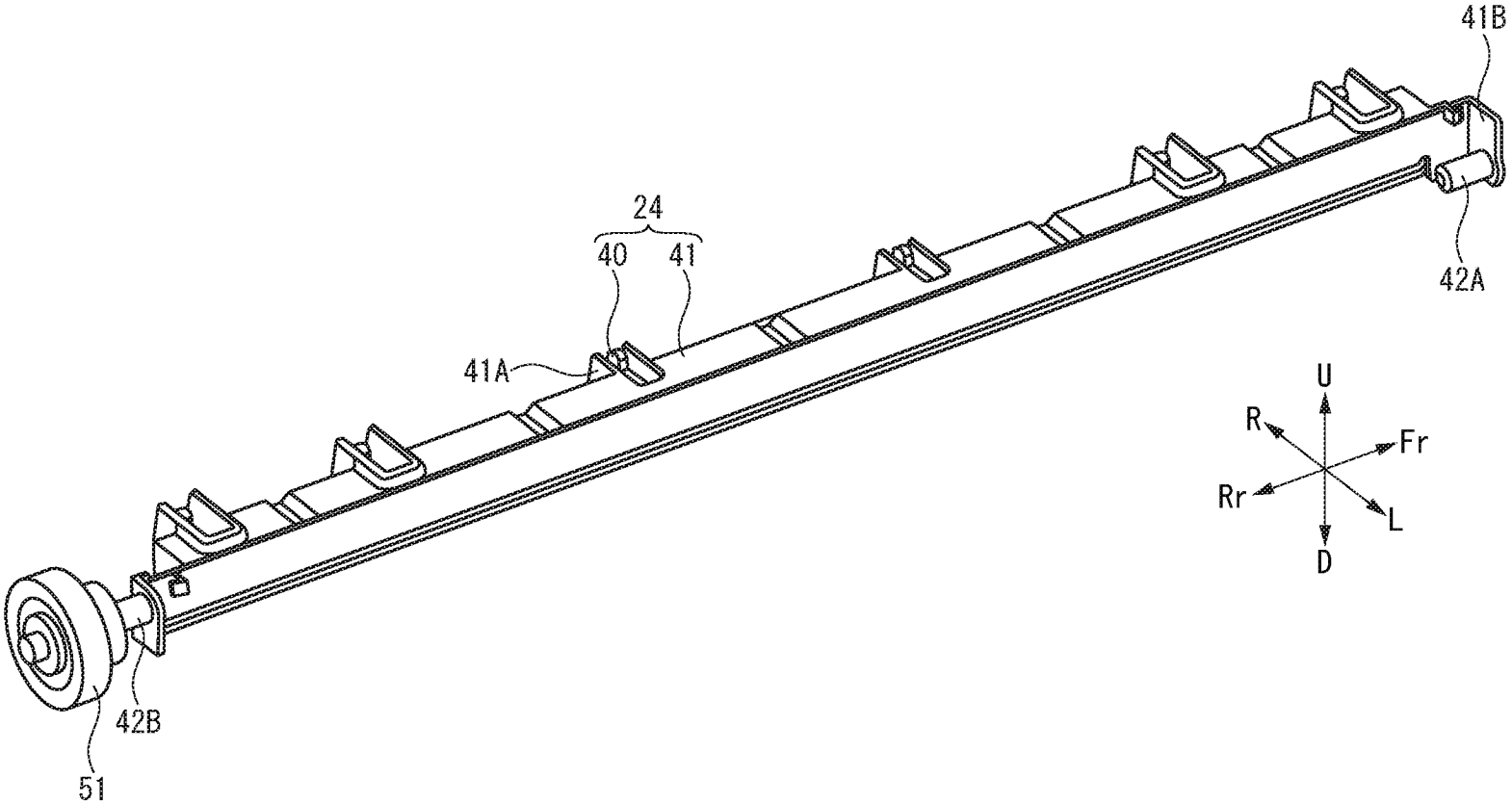
FIG. 6 is a perspective view showing the separating unit in the fixing device according to the embodiment of the present disclosure.
Figure 7:
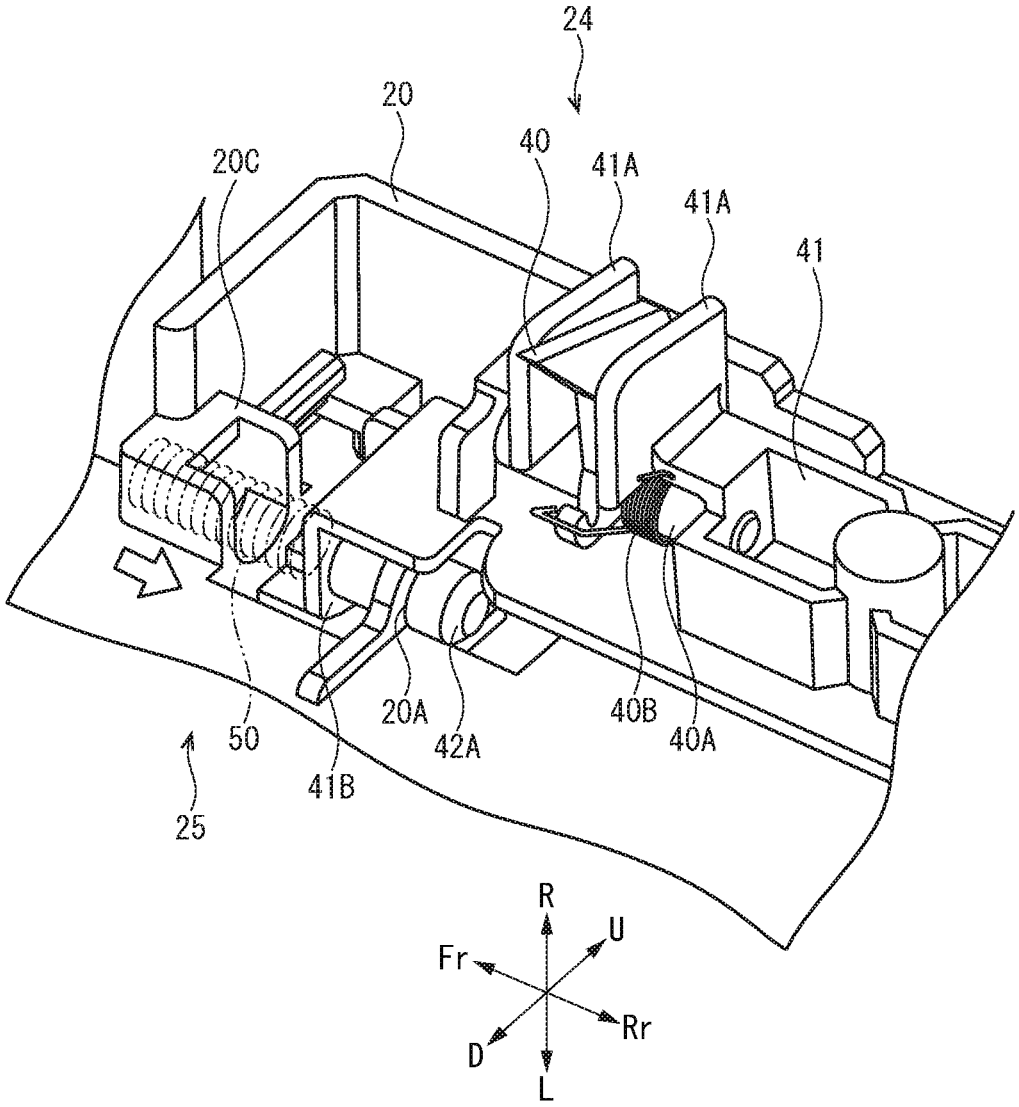
FIG. 7 is a perspective view showing front sides of the separating unit and others in the fixing device according to the embodiment of the present disclosure.
Figure 8:
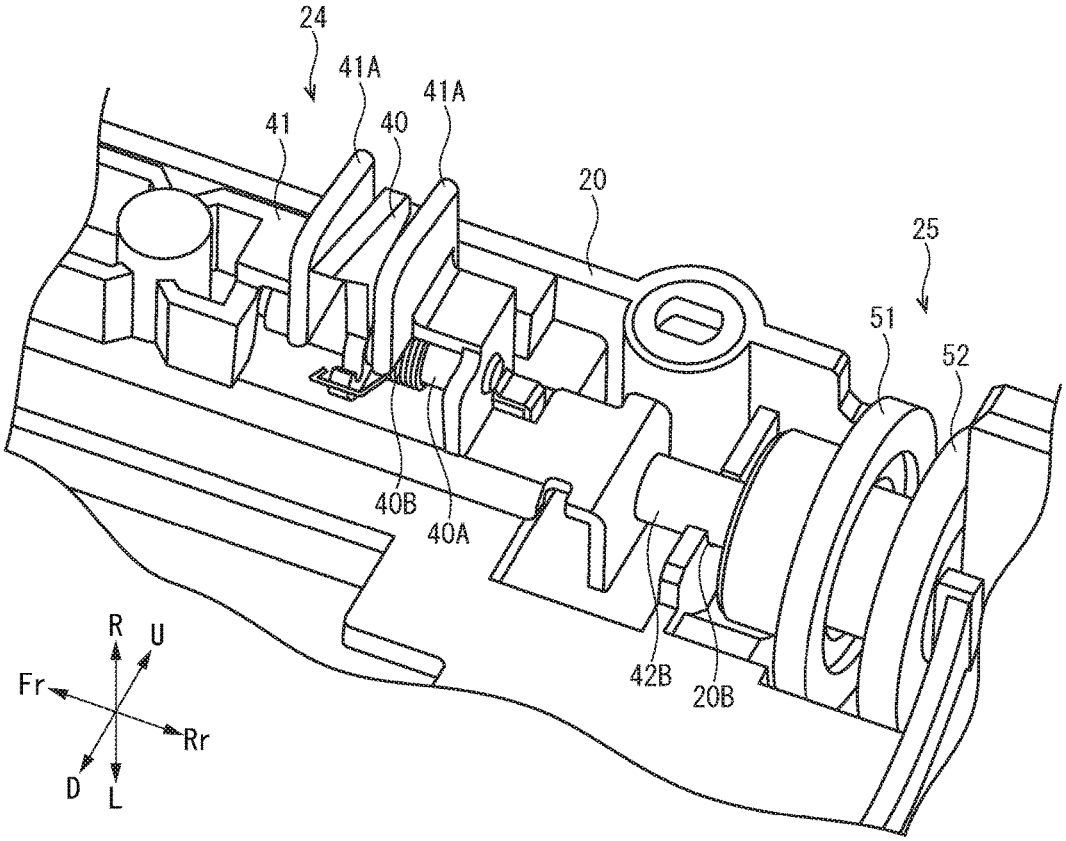
FIG. 8 is a perspective view showing rear sides of the separating unit and others in the fixing device according to the embodiment of the present disclosure.

Next, with reference to FIGS. 2-8, the fixing device 7 will be described. FIG. 2 is a sectional view showing the fixing device 7. FIG. 3 is a plane view schematically showing a part of the fixing device 7. FIG. is a perspective view showing a fixing belt 21, a separating unit 24 and others. FIG. 5 is a perspective view showing rear sides of the fixing belt 21, the separating unit 24 and others. FIG. 6 is a perspective view showing the separating unit 24. FIG. 7 is a perspective view showing front sides of the separating unit 24 and others. FIG. 8 is a perspective view showing rear sides of the separating unit 24 and others.

As shown in FIGS. 2 and 3, the fixing device 7 includes a casing 20, the fixing belt 21, a pressuring roller 22, a halogen heater 23, the separating unit 24 and a moving mechanism 25 (refer to FIG. 8). The casing 20 is supported by the apparatus body 2. The fixing belt 21 and the pressuring roller 22 are rotatably supported inside the casing 20. The halogen heater 23 is arranged inside the fixing belt 21. The separating unit 24 and the moving mechanism 25 are arranged at a downstream side from a contact portion (a pressuring area N) of the fixing belt 21 and the pressuring roller 22.

The casing 20 is made of heat-resistant resin or the like and formed in a roughly rectangular parallelepiped shape elongated in forward and backward directions. Inside the casing 20, a part of the conveying path 8 through which the sheet S passes is formed. In a lower part of the casing 20, an approach guide 26 guiding the sheet S to the pressuring area N is provided (refer to FIG. 2).

On the conveying path 8 inside the casing 20, a guiding member 27 and a pair of ejecting rollers 28 are provided. The guiding member 27 is attachably/detachably fastened (by a screw or the like) to the casing 20 at a downstream side from the pressuring area N in the conveying direction. The guiding member 27 constitutes a part of the conveying path 8 at the downstream side from the pressuring area N in the conveying direction. The pair of ejecting rollers 28 are provided at the downstream side from the guiding member 27 so as to rotate around an axis. The pair of ejecting rollers 28 have a function put the sheet S passed through the pressuring area N between the ejecting rollers 28 and conveying the sheet S to a downstream side.

Figure 4:
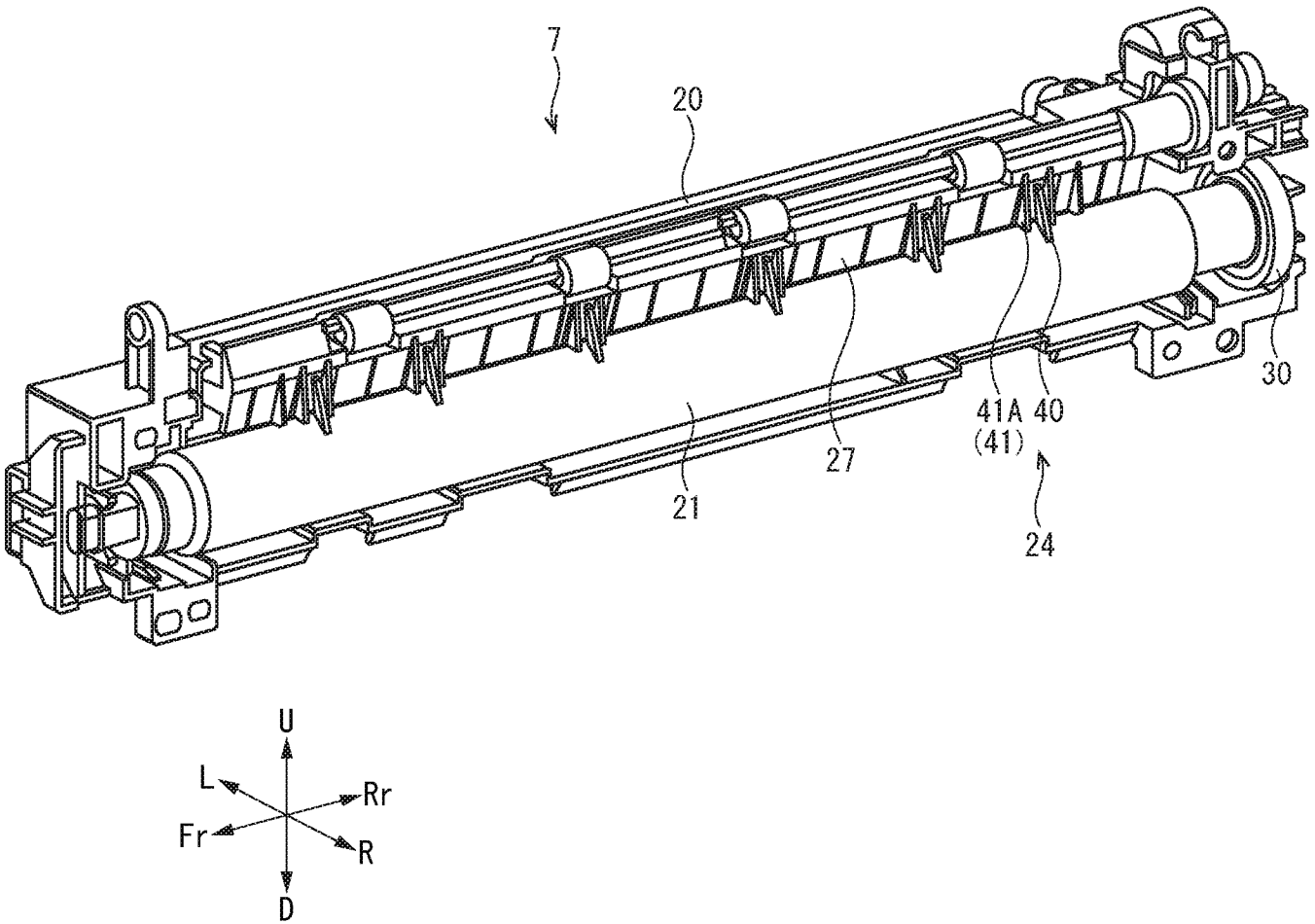
FIG. 4 is a perspective view showing a fixing belt, a separating unit and others in the fixing device according to the embodiment of the present disclosure.

As shown in FIGS. 2-4, the fixing belt 21 as an example of a fixing member is an endless belt and is formed in a roughly cylindrical shape elongated in the forward and backward directions (an axial direction). The fixing belt 21 is made of, for example, synthetic resin or the like having heat-resisting property and elasticity. As shown in FIGS. 3-5, to a rear part of the fixing belt 21, a fixing gear 30 is attached. As shown in FIG. 5, to the fixing gear 30, a driving motor M (of a pinion gear) is connected via a gear train 31 composed of a plurality of gears. The driving motor M is a driving source driving and rotating the fixing belt 21. The plurality of gears composing the gear train 31 are rotatably supported by the casing 20. Incidentally, the gear train 31 is connected to any one roller of the pair of ejecting rollers 28.

As shown in FIG. 2, inside the fixing belt 21, a press supporting member 32 and a pressing pad 33 are provided. The press supporting member 32 is made of metal and is formed in a roughly rectangular cylindrical shape elongated in the forward and backward directions and both front and rear ends of the press supporting member 32 penetrates the fixing belt 21 and are supported by lateral walls of the casing 20 (refer to FIG. 3). The pressing pad 33 is made of synthetic resin having heat-resisting property, formed in a roughly thick plate shape elongated in forward and backward directions and fixed to a right face of the press supporting member 32. The pressing pad has a function receiving the pressuring roller 22 pressured via the fixing belt 21.

As shown in FIGS. 2 and 3, the pressuring roller 22 as an example of a pressuring member is formed in a roughly cylindrical shape elongated in the forward and backward directions (the axial direction) and arranged at a right side of the fixing belt 21. The pressuring roller 22 includes a core metal 22A made of metal and an elastic layer 22B, such as silicon sponge, laminated on an outer circumferential face of core metal 22A. Both front and rear ends of the pressuring roller 22 (the core metal 22A) are rotatably supported by a pair of movable frames 34 (refer to FIG. 3). The movable frames 34 are supported by the casing 20 so as to swing in left and right directions and connected to a pressure adjusting part (not shown) including a spring, an eccentric cam and others.

When the pressure adjusting part turns the movable frames 34 to a side of the fixing belt 21, the pressuring roller 22 is pressured to the fixing belt 21 to form the pressuring area N being in compression pressured between the pressuring roller 22 and the fixing belt 21. On the other hand, when the pressure adjusting part turns the movable frames 34 to a direction separating from the fixing belt 21, pressuring of the pressuring roller 22 to the fixing belt 21 is released to form the pressuring area N being in decompression. Incidentally, the pressuring area N indicates an area within a range from an upstream side position where the pressure is 0 Pa to a downstream side position where the pressure is 0 Pa again via a position where the pressure is a maximum.

As shown in FIG. 2, the halogen heater 23 is formed in a roughly bar shape elongated in the forward and backward directions (the axial direction) and supported by the press supporting member 32. The halogen heater 23 includes a halogen lamp emitting light within an infrared region and heating the fixing belt 21. Incidentally, in the embodiment, the halogen heater 23 is applied as a heat source, but a carbon heater or the like may be applied instead of the halogen heater 23. Alternatively, an induction heating type heater may be arranged outside of the fixing belt 21.

Incidentally, inside the casing 20, a temperature sensor (not shown), such as a thermopile or a thermistor, sensing surface temperature of the fixing belt 21 (or temperature of the halogen heater 23) is provided. To the controlling device of the color printer 1, the driving motor M, the halogen heater 23, the temperature sensor and others are electrically connected. the controlling device controls the driving motor M, the halogen heater 23, the temperature sensor and others via various drive circuits.

As shown in FIGS. 4 and 5, the separating unit 24 is arranged above the fixing belt 21. As shown in FIGS. 4-6, the separating unit 24 includes a plurality of (e.g. six) separating claws 40 and a supporting frame 41. The plurality of separating claws 40 are supported by the supporting frame 41 arranged in parallel to the fixing belt 21. Incidentally, because the plurality of separating claws 40 have the same shape as each other, one separating claw 40 will be described hereinafter.

The separating claw 40 is formed in a roughly thick plate shape having a roughly acute triangle as viewed from the front side and comes into contact with a surface of the fixing belt 21 at a downstream side from the pressuring area N. As shown in FIGS. 7 and 8, in a proximal end (a root portion) of the separating claw 40, a rotating shaft 40A extended to both front and rear sides is provided. The rotating shaft 40A is rotatably supported by the supporting frame 41. Around the rotating shaft 40A, a torsion coil spring 40B is wound to bias the separating claw 40 toward the fixing belt 21.

As shown in FIG. 6, the supporting frame 41 is made of, for example, metal material and synthetic resin material and is formed in a roughly box shape elongated in the forward and backward directions. The supporting frame 41 is arranged above the fixing belt 21. The separating claw 40 described above is extended from a right side of the supporting frame 41 to the pressuring area N (refer to FIGS. 4 and 5). As shown in FIGS. 6 and 7, in a right face of the supporting frame 41, six pairs of protecting ribs 41A are formed and each pair of protecting ribs 41A are arranged at positions adjacent to both front and rear sides of each separating claw 40. Each protecting rib 41A is made of, for example, synthetic resin having heat-resisting property and protruded toward the conveying path 8 inside the casing 20.

As shown in FIG. 6, in both front and rear ends of the supporting frame 41, a first pin 42A and a second pin 42B are formed. The first pin 42A and the second pin 42B are formed in roughly cylindrical shapes extended in the forward and backward directions (the axial direction). The first pin 42A is fixed to a bent piece 41B bent from a front end (one end in the axial direction) of the supporting frame 41 to a left side (an opposite side to the separating claw 40). The first pin 42A is provided in a condition being extended from the bent piece 41B to a rear side (the other end side in the axial direction).

The second pin 42B is fixed on a rear end face of the supporting frame 41. To the second pin 42B, a input gear 51 of the moving mechanism 25 described later is rotatably fitted. The second pin 42B is provided in a condition being extended from the rear end face (the other end in the axial direction) of the supporting frame 41 to the rear side on the same axis as the input gear 51. Moreover, the first pin 42A described above is extended from the rear end of the supporting frame 41 to the front side at a position shifted from the input gear 51 (the second pin 42B) in a diameter direction (to the left side).

As shown in FIG. 7, in a front end (one end in the axial direction) of the casing 20, a first insertion hole 20A used for inserting the first pin 42A is formed. The first insertion hole 20A is a round hole into which the first pin 42A is inserted in the axial direction (from the front side). Moreover, as shown in FIG. 8, in a rear end (the other end in the axial direction) of the casing 20, a second insertion hole 20B used for inserting (fitting) the second pin 42B is formed. The second insertion hole 20B is a U-shaped groove into which the second pin 42A is fitted in the diameter direction (from the right side).

As shown in FIGS. 7 and 8, the respective pins 42A and 42B are slidably supported by the respective insertion holes 20A and 20B in a condition being inserted into the respective insertion holes 20A and 20B. Then, the supporting frame 41 becomes a condition being supported by the casing 20 so as to slide in the forward and backward directions via the respective pins 42A and 42B. Moreover, since the first pin 42A and the second pin 42B are supported by the casing 20 at positions shifted from each other in the diameter direction, the supporting frame 41 becomes a condition being supported by the casing 20 in a state that rotation around an axis is restricted. As shown in FIGS. 4 and 5, the guiding member 27 described above is arranged so as to cover the separating unit 24 (the supporting frame 41) in the condition that the respective pins 42A and 42B are inserted into the respective insertion holes 20A and 20B. Then, the guiding member 27 is fixed to the casing 20 so as to hold the second pin 42B fitted into the second insertion hole 20B. Incidentally, in the guiding member 27, a plurality of openings (not shown) used for penetration of each separating claw 40 and each protecting rib 41A are formed.

Figure 9:
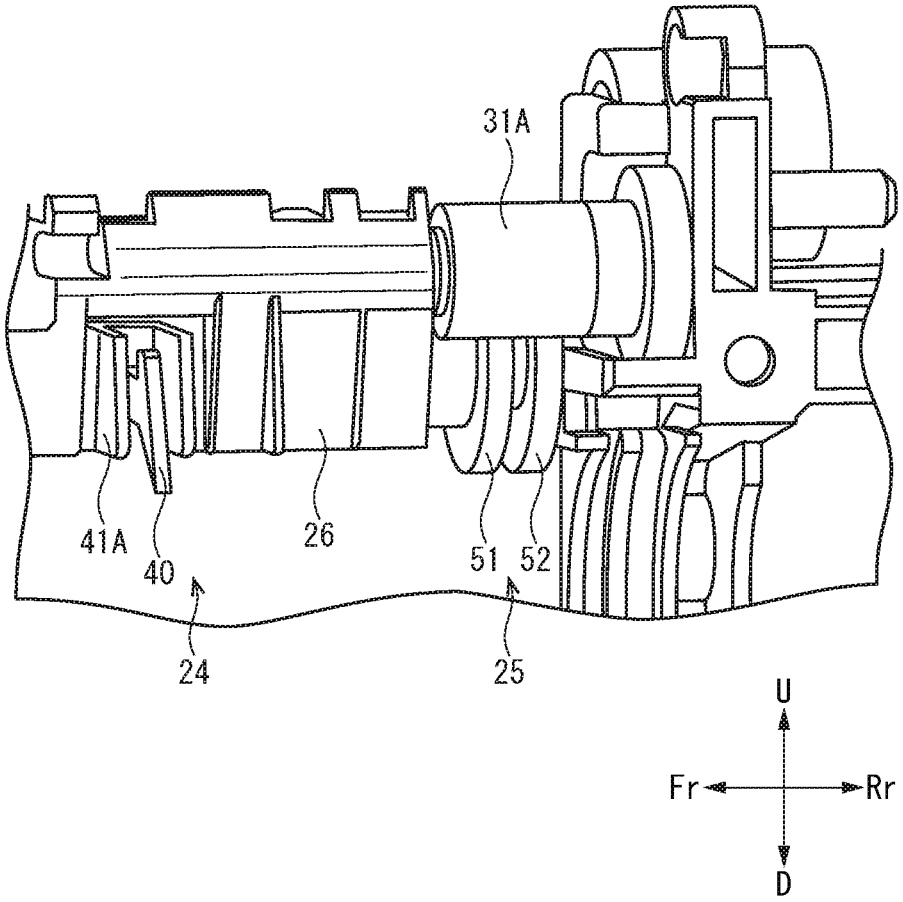
FIG. 9 is a perspective view showing rear sides of the separating unit, a moving mechanism and others in the fixing device according to the embodiment of the present disclosure.
Figure 10:
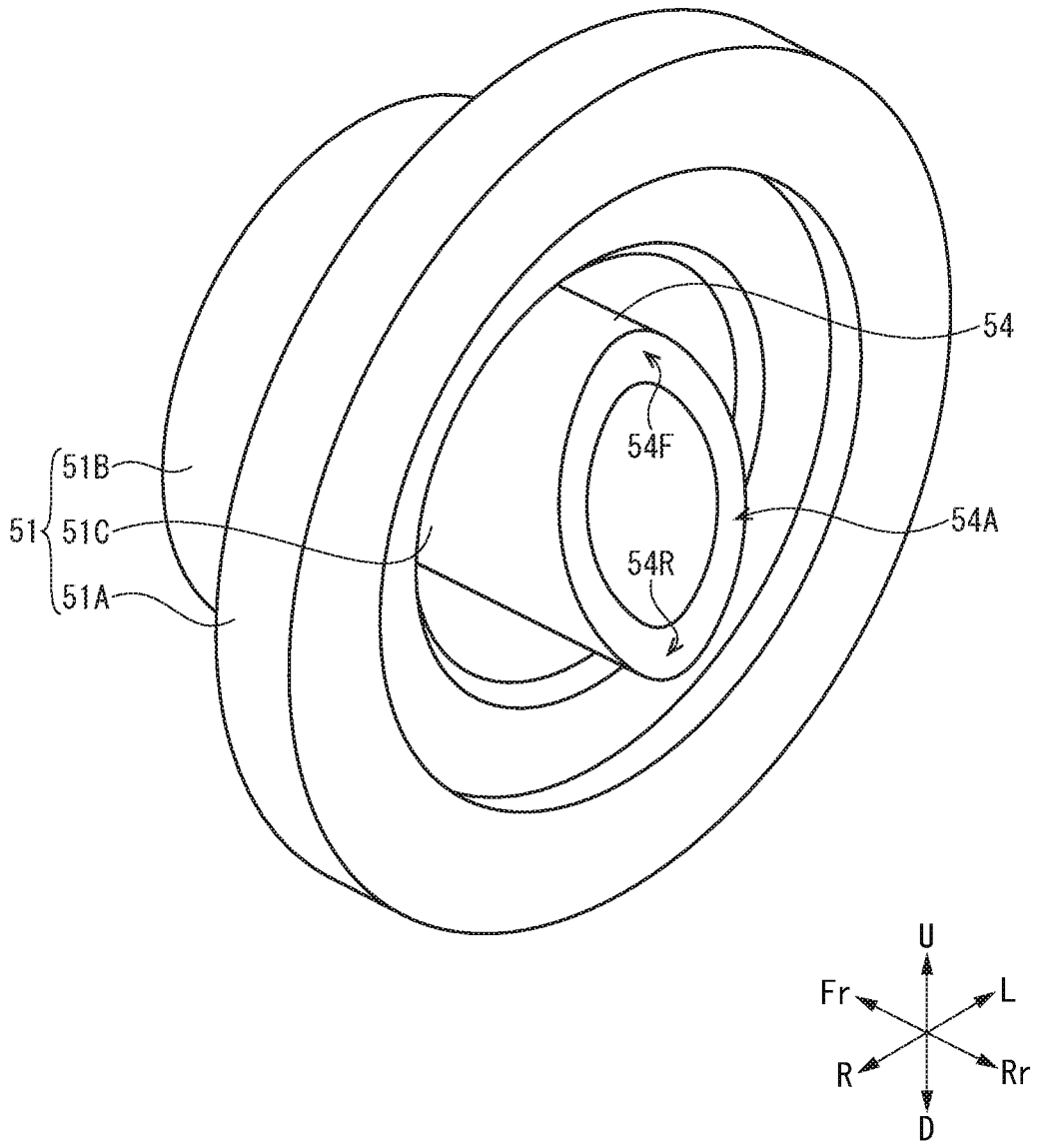
FIG. 10 is a perspective view showing a front input gear provided in the moving mechanism of the fixing device according to the embodiment of the present disclosure.
Figure 11:
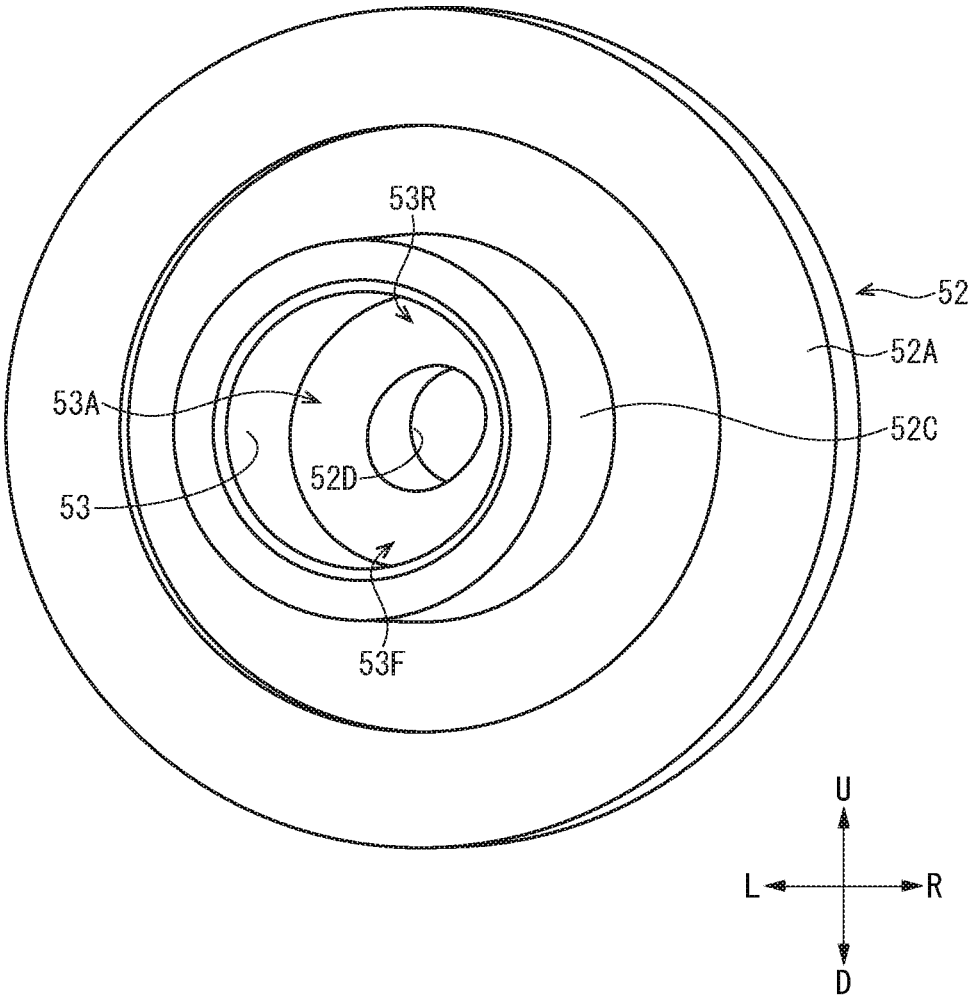
FIG. 11 is a perspective view showing a rear input gear provided in the moving mechanism of the fixing device according to the embodiment of the present disclosure.
Figure 12:
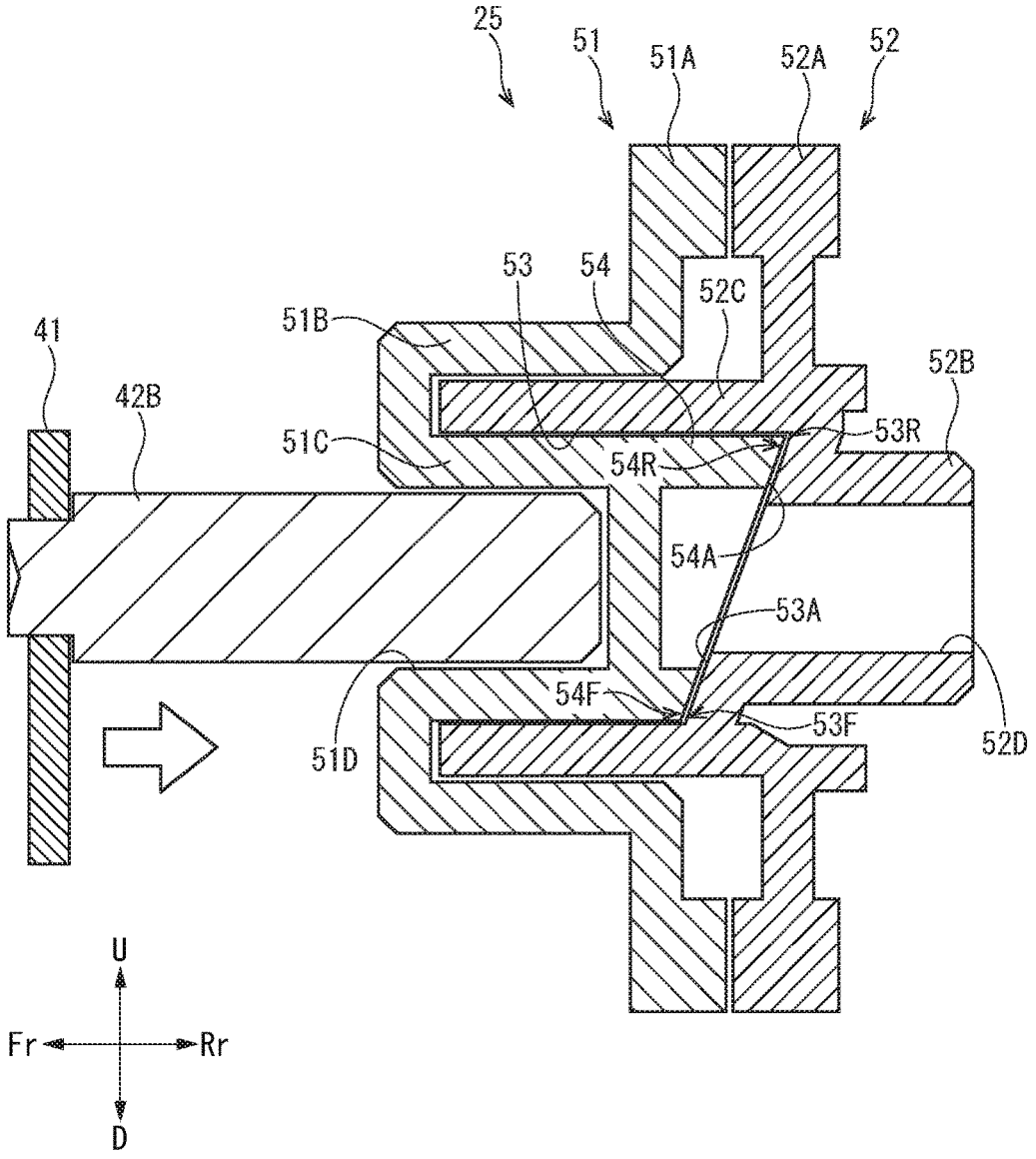
FIG. 12 is a sectional view showing a part of the moving mechanism, in a condition that the two input gears are closest to each other, in the fixing device according to the embodiment of the present disclosure.

Next, with reference to FIGS. 7-12, the moving mechanism 25 will be described. FIG. 9 is a perspective view showing rear sides of the separating unit 24, the moving mechanism 25 and others. FIG. 10 is a perspective view showing the front input gear 51 provided in the moving mechanism 25. FIG. 11 is a perspective view showing the rear input gear 52 provided in the moving mechanism 25. FIG. 12 is a sectional view showing a part of the moving mechanism 25, in a condition that the two input gears 51 and 52 are closest to each other.

The moving mechanism 25 includes a biasing member 50, the two input gears 51 and 52, a bearing depression 53 and a shaft protrusion 54.

As shown in FIG. 7, the biasing member 50 is a so-called compression coil spring and is installed between a spring receiving part 20C formed in the front end of the casing 20 and the bent piece 41B of the supporting frame 41. The biasing member 50 has a function biasing the separating claws 40 (the separating unit 24) from the front side to the rear side (from one side to the other side in the axial direction).

As shown in FIGS. 8 and 9, the two input gears 51 and 52 are spur gears arranged side by side on the same axis as each other. The two input gears 51 and 52 have different numbers of teeth from each other. In the embodiment, as an example, a difference between the numbers of teeth of the two input gears 51 and 52 is set to one tooth. For example, the numbers of teeth of the front input gear 51 is smaller by one than the numbers of teeth of the rear input gear 52. The two input gears 51 and 52 are meshed with one output gear 31A driven and rotated by the driving motor M (refer to FIG. 9). The output gear 31A is one gear (a spur gear) constituting the gear train 31 and is arranged at a right upper side of the two input gears 51 and 52. Incidentally, hereinafter, for convenience sake, the front input gear 51 is called as a "first input gear 51" and the rear input gear 52 is called as a "second input gear 52", and both input gears 51 and 52 are called as the "input gears 51 and 52" in a case of similar description.

As shown in FIGS. 10 and 12, the first input gear 51 includes a first gear body 51A, an outer tube 51B and an inner tube 51C. The first gear body 51A is formed in a roughly disk shape and, on an outer circumferential face of the first gear body 51A, a plurality of teeth are formed. The outer tube 51B is formed in a roughly cylindrical shape being coaxial with the first gear body 51A and protruded from a front end face of the first gear body 51A to the front side. The inner tube 51C is formed in a roughly cylindrical shape being coaxial with the outer tube 51B and protruded from an inner face of a front portion of the outer tube 51B to the rear side. In an axial center portion of the inner tube 51C, a bearing hole 51D used for inserting the second pin 42B is formed in a depressed condition (refer to FIG. 12). The first input gear 51 is rotatably supported by a circumference face of the second pin 42B inserted into the inner tube 51C.

As shown in FIGS. 11 and 12, the second input gear 52 includes a second gear body 52A and a supported shaft 52B. The second gear body 52A is formed in a roughly disk shape and, on an outer circumferential face of the second gear body 52A, a plurality of teeth are formed. The supported shaft 52B is formed in a roughly cylindrical shape being coaxial with the second gear body 52A and protruded from a rear end face of the second gear body 52A to the rear side. The supported shaft 52B is rotatably supported by a gear bearing (not shown) formed in the casing 20. Incidentally, in an axial center portion of the supported shaft 52B, a penetration hole 52D is formed.

As shown in FIGS. 11 and 12, the bearing depression 53 is formed in a front end face of the second input gear 52 in a depressed condition. In detail, the bearing depression 53 is formed in an axial center portion of a bearing tube 52C protruded from a front end face of the second gear body 52A to the front side. The bearing tube 52C has an outer diameter larger than the supported shaft 52B and is formed in a roughly cylindrical shape being coaxial with the supported shaft 52B. The bearing depression 53 is a depression having an inner diameter larger than the supported shaft 52B and has a contact face 53A inclined with respect to the axial direction in a bottom face (a rear face) of the bearing depression 53. In the contact face 53A, the penetration hole 52D is opened, and the contact face 53A is formed in a roughly annular shape as a step face between the bottom face of the bearing depression 53 and the penetration hole 52D.

As shown in FIGS. 10 and 12, the shaft protrusion 54 is protruded from the first input gear 51 to the second input gear 52. In detail, the shaft protrusion 54 is formed in a state extended from a distal end (a rear end) of the inner tube 51C to the rear side. The shaft protrusion 54 is formed in a roughly cylindrical shape having an outer diameter slightly smaller than an inner diameter of the bearing depression 53. A distal end face 54A of the shaft protrusion 54 is formed in a roughly annular shape inclined with respect to the axial direction. The distal end face 54A is inclined at the roughly same angle as the contact face 53A (refer to FIG. 12). The distal end face 54A is inserted into the bearing depression 53 and rotatably supported by the bearing depression 53 in a condition that the distal end face 54A is made contact with the contact face 53A. That is, the first input gear 51 to the second input gear 52 are relative-rotatably supported via the shaft protrusion 54 inserted into the bearing depression 53. Incidentally, in a condition that inclination directions of the distal end face 54A and the contact face 53A coincide with each other, a rear face of the first gear body 51A comes into contact with (or slightly separates from) the and a front face of the second gear body 52A.

Next, an action (fixing process) of the fixing device 7 will be described. Incidentally, in case where the fixing process is executed, the pressuring roller 22 is pressed to the fixing belt 21 by the pressure adjusting part.

First, the controlling device controls driving of the driving motor M and the halogen heater 23. The fixing belt 21 is rotated by receiving driving force of the driving motor M and the pressuring roller 22 is rotated by following the fixing belt 21 (refer to a fine solid line arrow in FIG. 2). The halogen heater 23 heats the fixing belt 21 from the inside of the fixing belt 21. The temperature sensor transmits a detection signal indicating temperature of the fixing belt 21 (or the halogen heater 23) via an input circuit. The controlling device, when receives the detection signal indicating reaching to setting temperature from the temperature sensor, starts the image forming process described above. The sheet S having the transferred toner image is inserted into the casing 20 and the fixing belt 21 heats the toner (the toner image) on the sheet S passing through the pressuring area N while being rotated around an axis. The pressuring roller 22 pressures the toner on the sheet S passing through the pressuring area N while being rotated around an axis. Then, the toner image if fixed on the sheet S. The plurality of separating claws 40 separate the sheet S passed through the pressuring area N from the surface of the fixing belt 21. Subsequently, the sheet S having the fixed toner image is fed to the outside of the casing 20 and ejected onto the ejected sheet tray 4.

Incidentally, since the fixing belt 21 is rotated while making the separating claws 40 contact with the surface of the fixing belt 21, a portion of the fixing belt 21 continuously coming into contact with the separating claws 40 is worn. Thereupon, in order to restrain were of the fixing belt 21, in this fixing belt 21, the moving mechanism 25 reciprocatingly moves the separating claws 40 in the axial direction in accordance with rotation of the fixing belt 21.

Figure 13:
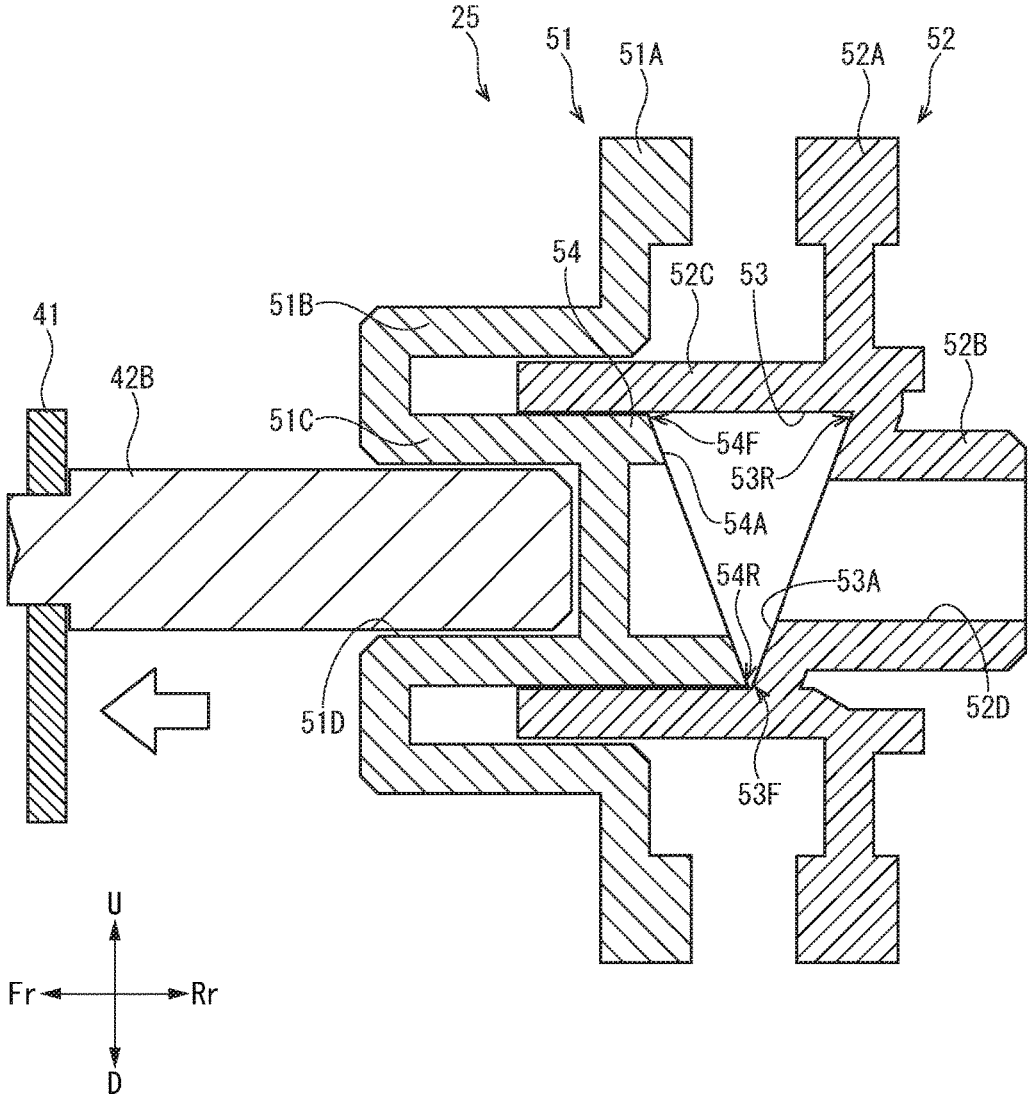
FIG. 13 is a sectional view showing a part of the moving mechanism, in a condition that the two input gears are farthest from each other, in the fixing device according to the embodiment of the present disclosure.

As shown in FIGS. 12 and 13, an action of the moving mechanism 25 will be described. FIG. 13 is a sectional view showing a part of the moving mechanism 25, in a condition that the two input gears 51 and 52 are farthest from each other.

The driving force of the driving motor M drives and rotates the two input gears 51 and 52 via the gear train 31 (the one output gear 31A). The moving mechanism reciprocatingly moves the separating unit 24 in the forward and backward directions (the axial direction) by cooperation of the biasing member 50, the bearing depression 53 and the shaft protrusion 54.

In detail, the biasing member 50 always biases the separating unit 24 (the supporting frame 41) to the rear side (refer to a void arrow in FIG. 7). The two input gears 51 and 52 are rotated around an axis while shifting by the difference of the numbers of teeth for each rotation. The first input gear 51 is delayed by an angle (a rotation angle) corresponding to one tooth for each rotation in comparison to the second input gear 52. Therefore, the distal end face 54A of the shaft protrusion 54 is rotated while relatively sliding on the contact face 53A of the bearing depression 53. Accordingly, the inclination direction of the contact face 53A with respect to the inclination direction of the distal end face 54A is varied for each rotation of the two input gears 51 and 52.

For example, as shown in FIG. 12, in a condition that the inclination directions of the distal end face 54A and the contact face 53A coincide with each other, when the two input gears 51 and 52 are rotated, the inclination directions of the distal end face 54A and the contact face 53A starts to be shifted in a rotation direction. That is, a rearmost portion 54R of the distal end face 54A is slidingly moved from a rearmost portion 53R to a foremost portion 53F in the contact face 53A in the rotation direction. Shifting of the inclination directions of the distal end face 54A and the contact face 53A is converted to force moving the separating unit 24 to the front side. Thereby, the separating unit 24 is moved to the front side against biasing force of the biasing member 50 (refer to a void arrow in FIG. 3). Thus, since shifting of the inclination directions of the distal end face 54A and the contact face 53A stepwisely occurs for each rotation of the two input gears 51 and 52, the separating unit 24 (the separating claws 40) is stepwisely moved in the axial direction very slowly.

When rotation of the two input gears 51 and 52 is advanced after a condition that the inclination directions of the distal end face 54A and the contact face 53A coincide with each other and the distal end face 54A is rotated by 180 degrees with respect to the contact face 53A (refer to FIG. 13), the bearing depression 53 and the shaft protrusion 54 become a condition that the rearmost portion 54R of the distal end face 54A comes into contact with the foremost portion 53F of the contact face 53A. In this condition, the two input gears 51 and 52 are farthest from each other and the separating unit 24 is moved at a foremost side. Incidentally, even in this condition, the shaft protrusion 54 is kept in a state being inserted into the bearing depression 53.

When rotation of the two input gears 51 and 52 is further advanced, the distal end face 54A and the contact face 53A go back to the condition that the inclination directions coincide with each other, and simultaneously, the separating unit 24 is biased by the biasing member 50 and moved to the rear side (refer to a void arrow in FIG. 12). When the distal end face 54A is rotated by 360 degrees with respect to the contact face 53A, the distal end face 54A and the contact face 53A become the condition that the inclination directions coincide with each other again and reciprocation of the separating unit 24 is completed once.

As described above, the two input gears 51 and 52 is rotated so as to repeat the condition being biased by the biasing member 50 to make the inclination directions of the contact face 53A and the distal end face 54A coincident with each other (refer to FIG. 12) and the condition being separated from each other against biasing force of the biasing member 50 by shifting the inclination directions of the contact face 53A and the distal end face 54A in the rotation direction (refer to FIG. 13), and thereby, reciprocatingly move the separating claws 40 in the axial direction. Incidentally, distances between the foremost portion 53F and 54F and the rearmost portion 53R and 54R in the contact face 53A and the distal end face 54A are set to a length of approximately two times of a width of the separating claw 40 in the axial direction. That is, the separating claw 40 is moved within a range of two times of the width in the axial direction.

The fixing device 7 according to the embodiment as described above is configured that the driving motor M of the fixing belt 21 drives and rotates the two input gears 51 and 52 of the moving mechanism 25 via the one output gear 31A. In such a configuration, it is possible to use the driving motor M of the fixing belt 21 commonly for as a driving source of the moving mechanism 25 reciprocatingly moving the separating claws 40 in the axial direction. Thereby, for example, in comparison to a case providing a special motor reciprocatingly moving the separating claws 40 in the axial direction, it is possible to reduce manufacturing cost of the fixing device 7 and to minimize the fixing device 7. Thus, in the fixing device 7, it is possible to move the separating claws 40 in the axial direction by a simple configuration.

Moreover, in the fixing device 7, the two input gears 51 and 52 repeat approaching and separating while varying a contact condition of the contact face 53A and the distal end face 54A by shifting by the difference of the numbers of teeth for each rotation, and thereby, reciprocatingly move the separating claws 40 in the axial direction. In such a configuration, it is possible to produce a slight speed difference between rotating speeds of the two input gears 51 and 52 on the basis of the difference of the numbers of teeth of the two input gears 51 and 52. That is, since the two input gears 51 and 52 having different the numbers of teeth greatly reduce and transmit rotating speed of the driving motor M, it is possible to slowly move the separating claws 40 in the axial direction. Thereby, it is possible to restrain wear of the fixing belt 21 due to sliding of the separating claws 40.

Further, in accordance with the fixing device 7 according to the embodiment, by setting difference of one tooth between the two input gears 51 and 52, it is possible to greatly reduce and transmit the rotating speed of the driving motor M and it is possible to reciprocatingly move the separating claws 40 in the axial direction very slowly.

Furthermore, in accordance with the fixing device 7 according to the embodiment, since a moving range of the separating claws 40 is set to a range being equal to or more than two times or equal to or less than three times of the width of the separating claw 40, it is possible to restrain the separating claws 40 from continuously coming into contact with the fixing belt 21 at the same position. Thereby, it is possible to restrain partial wear of the fixing belt 21.

As described above, because the separating claws come into contact with the surface of the rotating fixing belt 21, the separating claws 40 are dragged at a downstream side in the rotation direction of the fixing belt 21. Supposing that the first pin 42A and the second pin 42B are arranged on the same axis as the input gears 51 and 52, because the separating claws 40 are dragged along rotation of the fixing belt 21, it is necessary to provide other components restricting rotation of the separating claws 40. By contrast, in accordance with the fixing device 7 according to the embodiment, since the first pin 42A and the second pin 42B are engaged with the casing 20 on different axes, it is possible to restrain the separating claws 40 from rotating around the same axis as the input gears 51 and 52. Thereby, in comparison to a case providing other components restricting rotation, it is possible to reduce manufacturing cost. In addition, it is possible to suitably keep contact posture of the separating claws 40 with respect to the fixing belt 21.

Moreover, in accordance with the fixing device 7 according to the embodiment, since the second insertion hole 20B is formed in a roughly U-shape, it is possible to fit the second pin 42B into the insertion hole 20B after the first pin 42A is inserted into the first insertion hole 20A. Thereby, it is possible to easily carry out attachment of the separating claws 40 to the casing 20.

Incidentally, in the fixing device 7 according to the embodiment, although the six separating claws 40 are provided, the disclosure is not restricted by this and may include one or more separating claws 40.

Moreover, in the fixing device 7 according to the embodiment, although the difference of the numbers of teeth between the two input gears 51 and 52 is set to one tooth, the disclosure is not restricted by this and the difference of the numbers of teeth between the two input gears 51 and 52 may be set to two or more teeth. Then, in the embodiment, although the numbers of teeth of the first input gear 51 is smaller than the second input gear 52, the disclosure is not restricted by this and the numbers of teeth of the first input gear 51 may be larger than the second input gear 52. In addition, in the embodiment, although the biasing member 50 is arranged at the front side from the separating unit 24 and the two input gears and 52 are arranged at the rear side from the separating unit 24, the disclosure is not restricted by this. For example, the biasing member 50 may be arranged at the rear side from the separating unit 24 and the two input gears 51 and 52 may be arranged at the front side from the separating unit 24.

Further, in the fixing device 7 according to the embodiment, although the bearing depression 53 is formed in the second input gear 52 and the shaft protrusion 54 is formed in the first input gear 51, the disclosure is not restricted by this. For example, the bearing depression 53 may be formed in the first input gear 51 and the shaft protrusion 54 may be formed in the second input gear 52.

Furthermore, in the fixing device 7 according to the embodiment, although inclination of the contact face 53A and the distal end face 54A is formed so that the separating claws 40 reciprocatingly move a distance of two times of the width of the separating claw 40, the disclosure is not restricted by this. For example, the inclination of the contact face 53A and the distal end face 54A may be formed so that the separating claws 40 reciprocatingly move within a range being equal to or more than two times or equal to or less than three times of the width of the separating claw 40.

Moreover, in the fixing device 7 according to the embodiment, although the driving motor M drives and rotates the fixing belt 21, the disclosure is not restricted by this and the driving motor M may drive and rotate the pressuring roller 22. In addition, in the embodiment, although the pressure adjusting part moves the pressuring roller 22 to vary pressure force in the pressuring area N, the disclosure is not restricted by this and the pressure adjusting part moves the fixing belt 21 to vary pressure force in the pressuring area N.

Further, in the fixing device 7 according to the embodiment, although the fixing belt 21 rotated around one axis is applied as the fixing member, the disclosure is not restricted by this. As other examples, another belt (not shown) laid over a plurality of rollers or a fixing roller configured by laminating an elastic layer around an outer circumferential face of core metal may be applied as the fixing member.

Incidentally, although, in the present embodiment, a case where the present disclosure is applied to the color printer 1 has been described as one example, the disclosure is not restricted by this, but may be applied to a monochrome printer, a copying machine, a facsimile, a multifunction peripheral or the like.

Incidentally, the above-description of the embodiments illustrates one aspect of the toner conveying device and the image forming apparatus including this according to the present disclosure, but the technical scope of the disclosure is not limited to the above-described embodiments.

The invention claimed is:

1. A fixing device comprising:

a fixing member being rotatably provided around an axis, and heating a toner image on a recording medium;

a pressuring member being rotatably provided around an axis, forming a pressuring area between the fixing member and the pressuring member, and pressuring the recording medium passing through the pressuring area;

a separating claw separating the recording medium passed through the pressuring area from a surface of the fixing member; and a moving mechanism reciprocatingly moving the separating claw in an axial direction in accordance with rotation of the fixing member or the pressuring member, wherein the moving mechanism includes:

a biasing member biasing the separating claw from one side to the other side in the axial direction;

two input gears having different numbers of teeth from each other, being arranged side by side on the same axis as each other, being meshed with one output gear driven and rotated by a driving source driving and rotating the fixing member or the pressuring member, and rotating around an axis while shifting by a difference of the numbers of teeth for each rotation in a rotation direction;

a bearing depression being formed in one input gear of the input gears in a depressed condition, and having a contact face inclined with respect to the axial direction in a bottom face of the bearing depression; and a shaft protrusion being protruded from the other input gear to the one input gear of the input gears, and being supported by the bearing depression in a condition that a distal end face inclined with respect to the axial direction in the shaft protrusion is made contact with the contact face, the two input gears is rotated so as to repeat a condition being biased by the biasing member to make inclination directions of the contact face and the distal end face coincident with each other and a condition being separated from each other against biasing force of the biasing member by shifting the inclination directions of the contact face and the distal end face in the rotation direction, and thereby, reciprocatingly move the separating claw in the axial direction.

2. The fixing device according to claim 1 wherein, the difference the numbers of teeth of the two input gears is set to one tooth.

3. The fixing device according to claim 1 wherein,

The separating claw is moved within a range being equal to or more than two times or equal to or less than three times of the width of the separating claw in the axial direction.

4. The fixing device according to claim 1 wherein, the fixing member and the pressuring member are rotatably supported inside a casing, the separating claw is supported by a supporting frame arranged in parallel to the fixing member, the supporting frame includes:

a first pin being extended from one end to the other end of the supporting frame in the axial direction at a position shifted from the input gears in a diameter direction, and being inserted into a first insertion hole formed one end of the casing in the axial direction; and a second pin being extended from the one end to the other end of the supporting frame in the axial direction on the same axis as the input gears, and being inserted into a second insertion hole formed the other end of the casing in the axial direction.

5. The fixing device according to claim 4 further comprising;

a guiding member being attachably/detachably fastened to the casing at a downstream side from the pressuring area in a conveying direction of the recording medium, and constituting a part of a conveying path of the recording medium, wherein the second insertion hole of the casing is a U-shaped groove into which the second pin of the supporting frame is fitted in the diameter direction, the guiding member is fixed to the casing so as to hold the second pin fitted into the second insertion hole.

6. The fixing device according to claim 4, wherein the one input gear including the bearing depression is rotatably supported by the casing.

7. The fixing device according to claim 4, wherein the biasing member biases the supporting frame from one side to the other side in the axial direction.

8. An image forming apparatus comprising:

the fixing device according to claim 1.

9. An image forming apparatus comprising:

the fixing device according to claim 2.

10. An image forming apparatus comprising:

the fixing device according to claim 3.

11. An image forming apparatus comprising:

the fixing device according to claim 4.

12. An image forming apparatus comprising:

the fixing device according to claim 5.

13. An image forming apparatus comprising:

the fixing device according to claim 6.

14. An image forming apparatus comprising:

the fixing device according to claim 7.

* * * * *